US008265309B2

(12) United States Patent
Zhang

(10) Patent No.: US 8,265,309 B2
(45) Date of Patent: Sep. 11, 2012

(54) CONDENSER MICROPHONE

(75) Inventor: Rui Zhang, Shenzhen (CN)

(73) Assignees: AAC Acoustic Technologies (Shenzhen) Co. Ltd., Shenzhen (CN); American Audio Components Inc., La Verne, CA (US)

( * ) Notice: Subject to any disclaimer, the term of this patent is extended or adjusted under 35 U.S.C. 154(b) by 338 days.

(21) Appl. No.: 12/567,763

(22) Filed: Sep. 26, 2009

(65) Prior Publication Data

US 2010/0124343 A1 May 20, 2010

(30) Foreign Application Priority Data

Nov. 14, 2008 (CN) ..... 2008 1 0217339

(51) Int. Cl.
*H04R 25/00* (2006.01)

(52) U.S. Cl. ..... 381/174; 381/175; 381/369; 381/171; 381/178

(58) Field of Classification Search ..... 381/174, 381/175, 369
See application file for complete search history.

(56) References Cited

U.S. PATENT DOCUMENTS

| | | | | |
|---|---|---|---|---|
| 7,912,236 | B2 * | 3/2011 | Dehe et al. | 381/175 |
| 2006/0280319 | A1 * | 12/2006 | Wang et al. | 381/172 |
| 2008/0175418 | A1 * | 7/2008 | Zhang et al. | 381/174 |
| 2009/0092273 | A1 * | 4/2009 | Zhe et al. | 381/361 |
| 2009/0202089 | A1 * | 8/2009 | Zhang et al. | 381/174 |

* cited by examiner

*Primary Examiner* — Davetta W Goins
*Assistant Examiner* — Jasmine Pritchard

(57) ABSTRACT

A condenser microphone is disclosed. The condenser microphone includes a substrate having a cavity, a supporting member connected to the substrate, and a diaphragm isolated to the supporting member. The supporting member has a periphery portion and a plurality of stationary electrodes extending from the periphery portion to a center of the supporting member. The diaphragm has a vibrating member and a sustaining member connected to the vibrating member and the vibrating member defines a plurality of movable electrodes protruding from a periphery of the vibrating member. Each of the movable electrodes is located between two adjacent stationary electrodes and each of the stationary electrodes is located between two adjacent two movable electrodes.

11 Claims, 2 Drawing Sheets

CONDENSER MICROPHONE

BACKGROUND OF THE INVENTION

1. Field of the Invention

The present invention generally relates to the art of microphones and, more particularly, to a silicon based condenser microphone.

2. Description of Related Art

Silicon based condenser microphones also known as acoustic transducers have been researched and developed for more than 20 years. Because of potential advantages in miniaturization, performance, reliability, environmental endurance, low cost, and mass production capability, silicon based microphones are widely recognized to be the next generation product to replace electret condenser microphones (ECM) that has been widely used in communication devices, multimedia players, and hearing aids.

A related silicon based condenser microphone, comprises a backplate having a planar plate with a perforation therein, an anchor and a diaphragm paralleled and connected to the backplate by the anchor. The diaphragm can move along a direction perpendicularly to the planar plate of the backplate.

However, Such microphone has some disadvantages, such as low sensitivity, narrow frequency width and high noise. The present invention is provided to solve these problems.

SUMMARY OF THE INVENTION

In one embodiment of the present invention, a condenser microphone comprises a substrate having a through cavity, a supporting member connected to the substrate and located in the through cavity, and a diaphragm. The supporting member defines a first surface away from the substrate, a second surface opposite to the first surface, and an opening extending from the first surface to the second surface. The diaphragm locates in the opening and defines a third surface away from the supporting member and a fourth surface opposite to the third surface.

The supporting member comprises a periphery portion and a plurality of stationary electrodes extending from the periphery portion toward a center of the supporting member. The diaphragm comprises a vibrating member and a sustaining member connected to the vibrating member. The vibrating member defines a plurality of movable electrodes protruding from a periphery of the vibrating member. Each of the movable electrode is located between two adjacent stationary electrodes, and each of the stationary electrodes is located between two adjacent movable electrodes.

Other features of the present invention will become more apparent to those skilled in the art upon examination of the following drawings and detailed description of exemplary embodiment.

DETAILED DESCRIPTION OF THE PREFERRED EMBODIMENT

Reference will now be made to describe the preferred embodiment of the present invention in detail.

Figure 1:
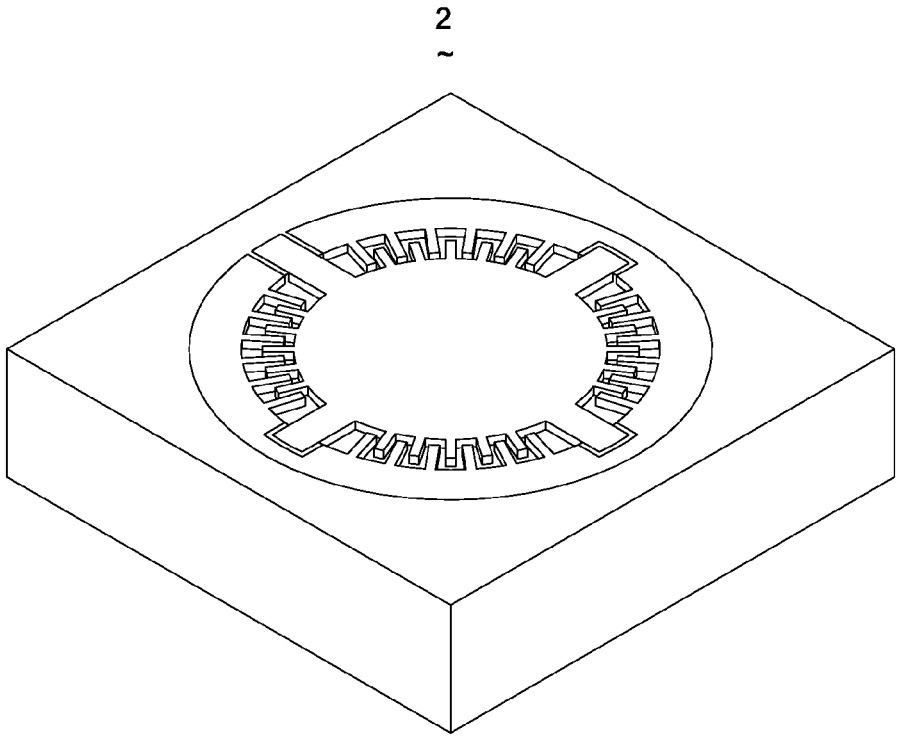
FIG. 1 shows an isometric view of a condenser microphone in accordance with one embodiment of the present invention.

Referring to FIG. 1, a condenser microphone 2 in accordance with an embodiment of the present invention is generally used in a mobile phone for receiving sound wave and converting acoustic signals to electric signals.

Figure 2:
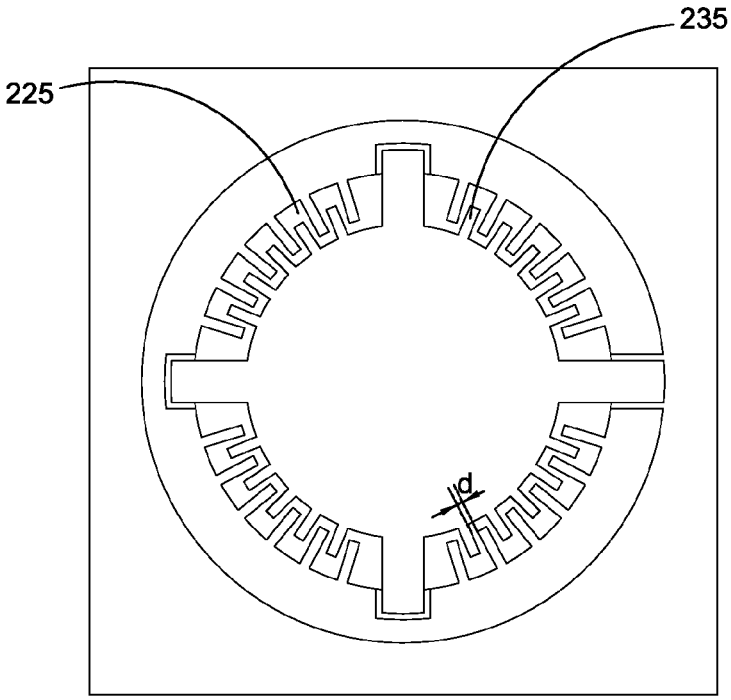
FIG. 2 is a cross-sectional view of the condenser microphone in FIG. 1.
Figure 3:
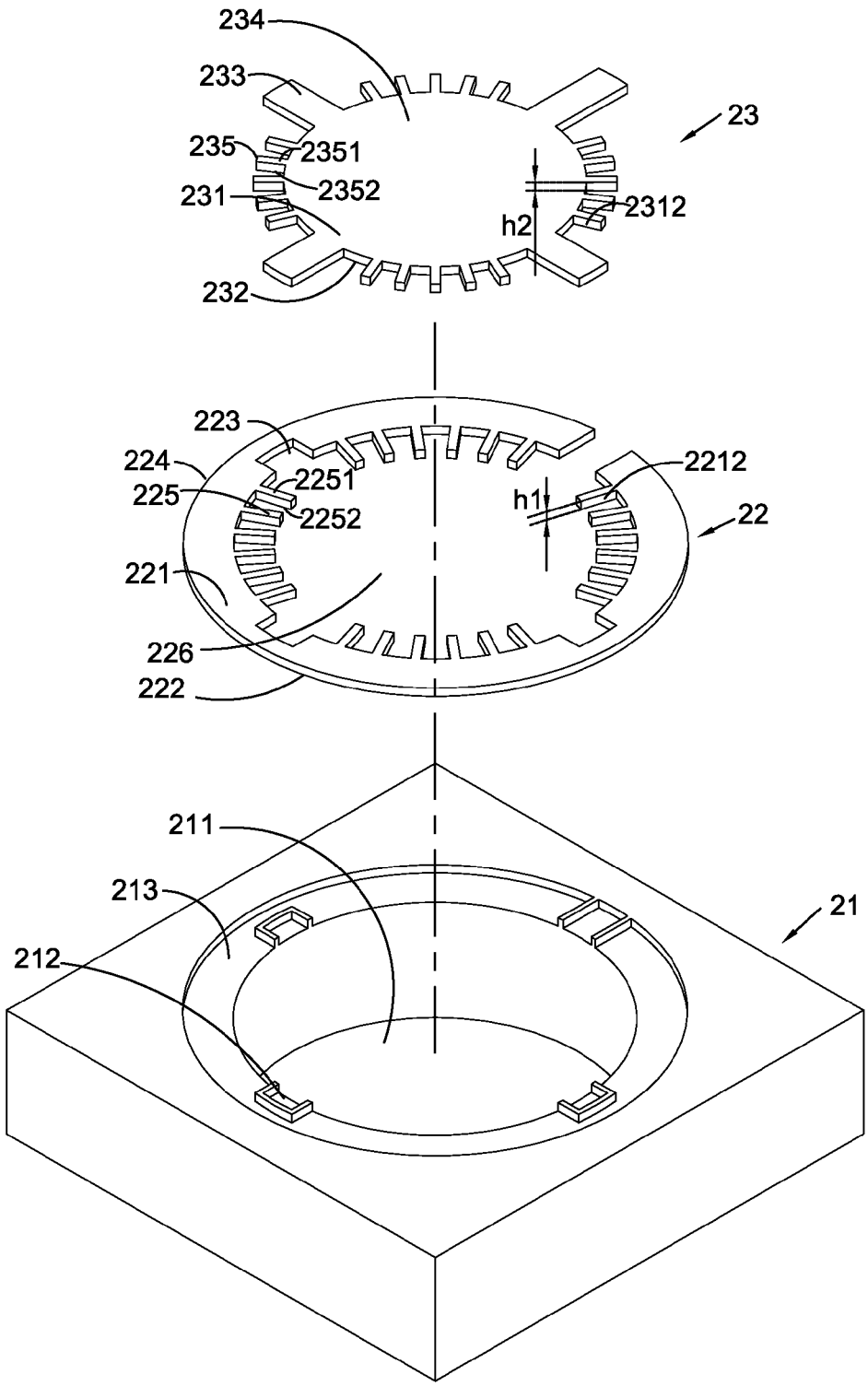
FIG. 3 is an exploded view of the condenser microphone in FIG. 1.

Referring to FIGS. 2-3, the condenser microphone 2 comprises a substrate 21, a supporting member 22 connected to the substrate 21, and a diaphragm 23 located on the substrate 21.

The substrate 21 defines a through cavity 211 and a sidestep 213. The supporting member 22 is supported by the sidestep 213 and is located in the through cavity 211. Another word, the supporting member 22 sits on the sidestep 213 and faces the through cavity 211.

The supporting member 22 defines a first surface 221 away from the substrate 21 and a second surface 222 opposite to the first surface 221. An opening 226 extends from the first surface 221 to the second surface 222. The diaphragm 23 is located in the opening 226 and is supported by the sidewall 213. The diaphragm 23 defines a third surface 231 away from the supporting member 22 and a fourth surface 232 opposite to the third surface 231.

The supporting member 22 comprises a periphery portion 224 and a plurality of stationary electrodes 225 extending from the periphery portion 224 toward a center of the supporting member 22. Each of the stationary electrodes 225 has a first top surface 2251 facing to the diaphragm 23, a first bottom surface 2252 opposite to the first top surface 2251. A first side surface 2212 connecting the first top surface 2251 and the first bottom surface 2252 and a first thickness h1 defined by the first side surface 2212.

The diaphragm 23 is used to respond to fluid-transmitted acoustic pressure and is isolated to the supporting member 22. The diaphragm 23 comprises a vibrating member 234 and a plurality of sustaining members 233 extending from the vibrating member 234. The vibrating member 234 defines a plurality of movable electrodes 235 protruding from a periphery of the vibrating member 234. Each of the movable electrodes 235 has a second bottom surface 2352 facing the supporting member 22, a second top surface 2351 opposite to the second bottom surface 2352. A second side surface 2312 connecting the second bottom surface 2352 and the second top surface 2351 and a second thickness h2 defined by the second side surface 2312. The sustaining member 233 includes a plurality of cantilevers 233 protruding from a periphery of the diaphragm 23 along a direction through a center of the diaphragm 23. The sustaining member 233 includes four cantilevers or five cantilevers. The numbers of the cantilevers also can be two, three or others.

As known, the condenser microphone 2 further comprises a plurality of conductive wires (not shown) for providing the stationary electrodes 225 and the movable electrodes 235 with electric charge.

As shown in FIG. 2, each of the movable electrode 235 is located between two adjacent stationary electrode 225, and each of the stationary electrode 225 is located between two adjacent movable electrodes 235.

Referring to FIG. 3, the substrate 21 has a plurality of grooves 212 for receiving the sustaining members 233 of the diaphragm 23. Accordingly, the supporting member 22 defines a plurality of third gaps 223, each of the third gaps 223 receiving one groove 212. The surface of the groove 212 is insulated.

The stationary electrodes 225 form a first capacitive plate of the condenser microphone and the movable electrodes 235 form a second capacitive plate of the condenser microphone. The value of every capacitance is given by:

$$C=k\epsilon 0\epsilon rS/d$$

In which, k, $\epsilon r$ and $\epsilon 0$ are all constants. S is the area that the first side surface 2212 overlaps the second side surfaces and d is the distance between the stationary electrode 225 and the movable electrode 235. As the value C of total capacitance of the condenser microphone 2 is determined by the distance between the adjacent stationary electrode 225 and the movable electrode 235, and by the area overlapped by the first side surface 2212 and the second side surface 2312, other than the size of the diaphragm 23, size of the diaphragm 23 can be minimized. As a result, the linearity of the condenser microphone 2 in accordance with the present invention is improved. Further the condenser microphone 2 has advantages, such as good frequency band, high sensitivity and low noise.

In the embodiment mentioned above, the first thickness h1 of the stationary electrode 225 is equal to the second thickness h2 of the movable electrode 235 which can further improve the performance of the condenser microphone.

The first top surface 2251 of the stationary electrodes 225 is co-planar to the second top surface 2351 of the movable electrodes. Additionally, the first top surface 2251 of the stationary electrodes 225, the second top surface 2351 of the movable electrodes, the first surface 221 of the supporting member 22 and the third surface 231 of the diaphragm 23 are co-planar to each other.

While the present invention has been described with reference to a specific embodiment, the description of the invention is illustrative and is not to be construed as limiting the invention. Several of modifications to the present invention can be made to the preferred embodiment by those skilled in the art without departing from the true spirit and scope of the invention as defined by the appended claims.

What is claimed is:

1. A condenser microphone comprising:

a substrate having a through cavity;

a supporting member connected to the substrate and located in the cavity, the supporting member defining a first surface away from the substrate, a second surface opposite to the first surface, and an opening extending from the first surface to the second surface, the supporting member further having a periphery portion and a plurality of stationary electrodes extending from the periphery portion toward a center of the supporting member, each of the stationary electrodes having a first top surface, a first bottom surface opposite to the first top surface and a first thickness;

a diaphragm, located in the opening, defining a third surface away from the supporting member, a fourth surface opposite to the third surface and facing to the substrate, the diaphragm having a vibrating member and sustaining members connected to the vibrating member, the vibrating member defining a plurality of movable electrodes protruding from a periphery of the vibrating member, each movable electrode having a second bottom surface facing to the substrate, a second top surface opposite to the second bottom surface and a second thickness; wherein each of the movable electrodes is located between two adjacent stationary electrodes, and each of the stationary electrodes is located between two adjacent movable electrodes.

2. The condenser microphone as described in claim 1, wherein the substrate has at least one groove for receiving the sustaining members of the diaphragm, and the supporting member has a third gap corresponding to the groove.

3. The condenser microphone as described in claim 1, wherein the first thickness of the stationary electrode is equal to the second thickness of the movable electrode.

4. The condenser microphone as described in claim 1, wherein the first top surface and the second top surface are co-planar to each other.

5. The condenser microphone as described in claim 1, wherein the first top surface, the second top surface, the first surface and the third surface are co-planar to each other.

6. The condenser microphone as described in claim 1, wherein the sustaining members include a plurality of cantilevers protruding from the periphery of the diaphragm along a direction through a center of the diaphragm.

7. The condenser microphone as described in claim 6, wherein the sustaining members include four cantilevers.

8. The condenser microphone as described in claim 1, wherein the substrate defines a sidestep, the supporting member sits on the sidestep and faces the through cavity.

9. A condenser microphone, comprising:

a substrate;

a supporting member sitting on the substrate and having a plurality of first electrodes, every two adjacent first electrodes defining a first gap therebetween, the supporting member further defining a first surface, a second surface opposite to the first surface and an opening extending from the first surface to the second surface;

a diaphragm isolated from the supporting member and located in the opening, and having a plurality of second electrodes, every two adjacent second electrodes defining a second gap therebetween; wherein each of the first electrodes is located in the second gap, and each of the second electrodes is located in the first gap.

10. The condenser microphone as described in claim 9, wherein the substrate has a plurality of grooves for receiving the diaphragm and the supporting member defines a plurality of third gaps, each of the third gaps receiving one groove, the surface of the plurality of grooves is insulated.

11. The condenser microphone as described in claim 9, wherein the substrate defines a sidestep and a cavity, the supporting member sits on the sidestep and faces the cavity.

* * * * *